US007188497B2

(12) United States Patent
Mella et al.

(10) Patent No.: US 7,188,497 B2
(45) Date of Patent: Mar. 13, 2007

(54) METHOD FOR STRAIGHTENING AN ECCENTRIC SHAFT

(75) Inventors: Ramon A. Mella, Greenfield, IN (US); Chad A. Selch, Martinsville, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 75 days.

(21) Appl. No.: 11/100,701

(22) Filed: Apr. 7, 2005

(65) Prior Publication Data

US 2006/0225478 A1 Oct. 12, 2006

(51) Int. Cl.
*B21C 51/00* (2006.01)

(52) U.S. Cl. ..... 72/31.03; 72/7.4; 72/110

(58) Field of Classification Search ..... 72/7.1, 72/7.4, 31.03, 107, 110, 342.1, 31.02, 74, 72/76, 366.2; 29/6.01, 888.08
See application file for complete search history.

(56) References Cited

U.S. PATENT DOCUMENTS 3,948,076 A * 4/1976 Eitel et al. ..... 72/384
4,860,566 A 8/1989 Augustin
5,001,917 A 3/1991 Berstein
5,138,859 A 8/1992 Winkens
5,235,838 A 8/1993 Berstein
5,333,480 A 8/1994 Berstein
5,445,003 A 8/1995 Gottschalk et al.
5,493,761 A 2/1996 Bone
5,495,738 A 3/1996 Gottschalk
5,575,167 A * 11/1996 Gottschalk et al. ..... 72/110
5,943,893 A * 8/1999 Goedderz et al. ..... 72/110
6,094,956 A 8/2000 Vodopyanov et al.
6,393,885 B1 5/2002 Cadena
6,651,474 B2 11/2003 Heimann
6,666,061 B2 12/2003 Heimann
6,895,793 B2 5/2005 Heffron et al.

FOREIGN PATENT DOCUMENTS

JP 59-101228 * 6/1984

* cited by examiner

*Primary Examiner*—Ed Tolan
(74) *Attorney, Agent, or Firm*—Elias P. Soupos; Susan L. Lukasik; Jeffrey P. Calfa

(57) ABSTRACT

A method for straightening an eccentric shaft (100, 501) by engaging fillets (201, 601) adjacent an element (101, 509) of the shaft with angled rollers (303, 703), rotating the shaft and selectively applying a compressive rolling force (301, 709) during only a portion of the rotation into the fillets (201, 601) of the shaft through the rollers (303, 703), which results in straightening the crankshaft (100).

20 Claims, 8 Drawing Sheets

METHOD FOR STRAIGHTENING AN ECCENTRIC SHAFT

FIELD OF THE INVENTION

This invention relates to a method for straightening eccentric shafts of the type used in internal combustion engines, such as camshafts or crankshafts, especially previously hardened shafts, by deep fillet rolling.

BACKGROUND OF THE INVENTION

Eccentric shafts are made for a variety of uses. One of the most common uses is in internal combustion engines. In a piston-driven internal combustion engine the power is generated within a plurality of cylinders by reciprocating pistons which, depending on the combustion cycle employed, compress air or a combustible mixture of fuel and air for subsequent ignition. The pistons follow a reciprocating axial path, and are connected on a side opposite to their combustion face to connecting rods. The connecting rods are in turn connected to an eccentric shaft, the crankshaft. The crankshaft is used to translate the axial reciprocating motion of the pistons into rotational motion. The pressures generated by combustion in the cylinder acting through this rotational motion create the power output of the engine. Another eccentric shaft, the camshaft, is typically used in internal combustion engines to control the timing of the intake and exhaust valves in the cylinders.

Eccentric shafts are required to withstand both high torsional loading, as well as millions of load cycles. For this reason eccentric shafts are usually made of strong and ductile materials, such as steel, and are often hardened for added strength, either by cold working, or by heat treating, or by induction hardening the eccentric shaft to change the crystalline structure of the metal in the high load concentration areas to increase strength. The straightness of the eccentric shaft is critical to its operation, partly because it has to fit within the engine structure and partly because a lack of straightness can cause severe vibration. Straightness also gives the eccentric shaft good balance for rotation and reduces torsional vibrations.

An acceptable hardening process for certain internal combustion engines is roll hardening or cold working a crankshaft by rolling fillets on the edges of crankpin and main journal segments. However, in high output engines, particularly diesel engines, roll hardening may not produce sufficient crankshaft strength.

Induction hardening is a widely used process for the surface hardening of steel eccentric shafts. For example, a crankshaft is heated by alternating magnetic fields to a temperature within or above the transformation range of steel, followed by immediate quenching. The core of the crankshaft remains unaffected by the treatment, and its physical properties are those of the material it was initially formed in, but the hardness of the case is considerably increased by residual compressive stresses in the material, a result of quenching.

Eccentric shafts oftentimes may develop excessive run-out, or axial misalignment, partly as a result of residual stresses from the machining and induction hardening operations. In such cases, the run-out renders a part non-conforming to the eccentric shaft specifications, potentially resulting in scrap of a relatively expensive component. This is particularly important in a high volume production process because the material rejected increases cycle time and rework cost, as well as scrap rates.

The traditional method to straighten induction-hardened eccentric shafts is to straighten them using a press straightener to impart a load in a single plane to the eccentric shaft. However, the resulting deflection of the eccentric shaft may push a portion of the hardened case out of compression and into tension, thus locally lowering the strength of the shaft.

Accordingly, there is a need for straightening eccentric shafts, such as engine crankshafts and camshafts, and especially induction-hardened crankshafts and camshafts, without compromising their strength.

SUMMARY OF THE INVENTION

The present invention is directed to a method for straightening eccentric shafts, such as engine crankshafts or a camshafts, using a deep fillet rolling process wherein the load is applied to internal or external fillets only at preselected locations and during specific rotational phase angles, to reposition one or more features, such as a crank pin, relative to an adjacent feature, such as a counterweight, thereby straightening the eccentric shaft about its major axis of rotation. The method of the invention finds special advantage when used for straightening an induction-hardened shaft.

A preferred implementation of the invention may be illustrated by a method of straightening a crankshaft in accordance with the invention. The method may be implemented by engaging a pin or a journal of a previously induction-hardened crankshaft with rollers, with at least one set of rollers disposed at an angle to the shaft axis in the fillets disposed between a crankpin or main journal and the adjacent counterweights, and applying a compressive rolling force to the crankpin or main journal of the crankshaft through the rollers. The magnitude of the compressive rolling force applied through the rollers varies according to the phase angle of rotation of the shaft, i.e., the magnitude of the rolling force is advantageously increased during certain selected points of crankshaft rotation, while the shaft loading is at nominal levels during other portions of the rotation, to cause plastic deformation of a circumferential segment of the crank pin or main journal corresponding to the selected point of rotation. The rollers provide an axial force component that slightly elongates such segment of the crankpin or main journal in an axial direction while other segments, including a segment diametrally opposite from the elongated segment, are subjected to much lower forces and remain relatively unaffected or only slightly affected. This imbalance between the effects on the highly loaded segment and the other segments results in slightly changing the angle between the crankpin or journal and the adjacent counterweights, thereby straightening the crankshaft.

In an alternative embodiment of the method, compressive rolling force may be applied to the each side of a journal of a camshaft with rollers in the fillets between the journal and the main shaft again providing an axial force component. The magnitude of the compressive rolling force applied through the rollers varies according to the phase angle of rotation of the shaft, i.e., the magnitude of the rolling force is advantageously increased during certain selected points of camshaft rotation corresponding to a radial plane of the camshaft in which the run-out is greatest, and the shaft may be unloaded or lightly loaded at other times, to cause plastic deformation of the camshaft journal which slightly compresses a segment of the journal corresponding to such radial plane while other segments, including a segment diametrally opposite from the compressed segment, remain relatively unaffected or only slightly affected. The imbalance between the plastic deformation of the compressed segment and the other segment results in changing the angle between the axial faces of the journal in the radial plane of maximum run-out and results in straightening the camshaft in such plane.

DESCRIPTION OF A PREFERRED EMBODIMENT

The following describes a method of straightening a hardened eccentric shaft for an internal combustion engine, such as a crankshaft or camshaft, by the use of a selectively-programmed deep rolling machine. This invention provides a method for straightening eccentric shafts that have been hardened, preferably induction-hardened, without losing the residual compressive stresses and fatigue strength thereof. An induction hardened shaft has regions where the material of the shaft is steel having a martensitic structure. Martensite is the hard constituent that is the chief component of quenched steel.

Figure 1:
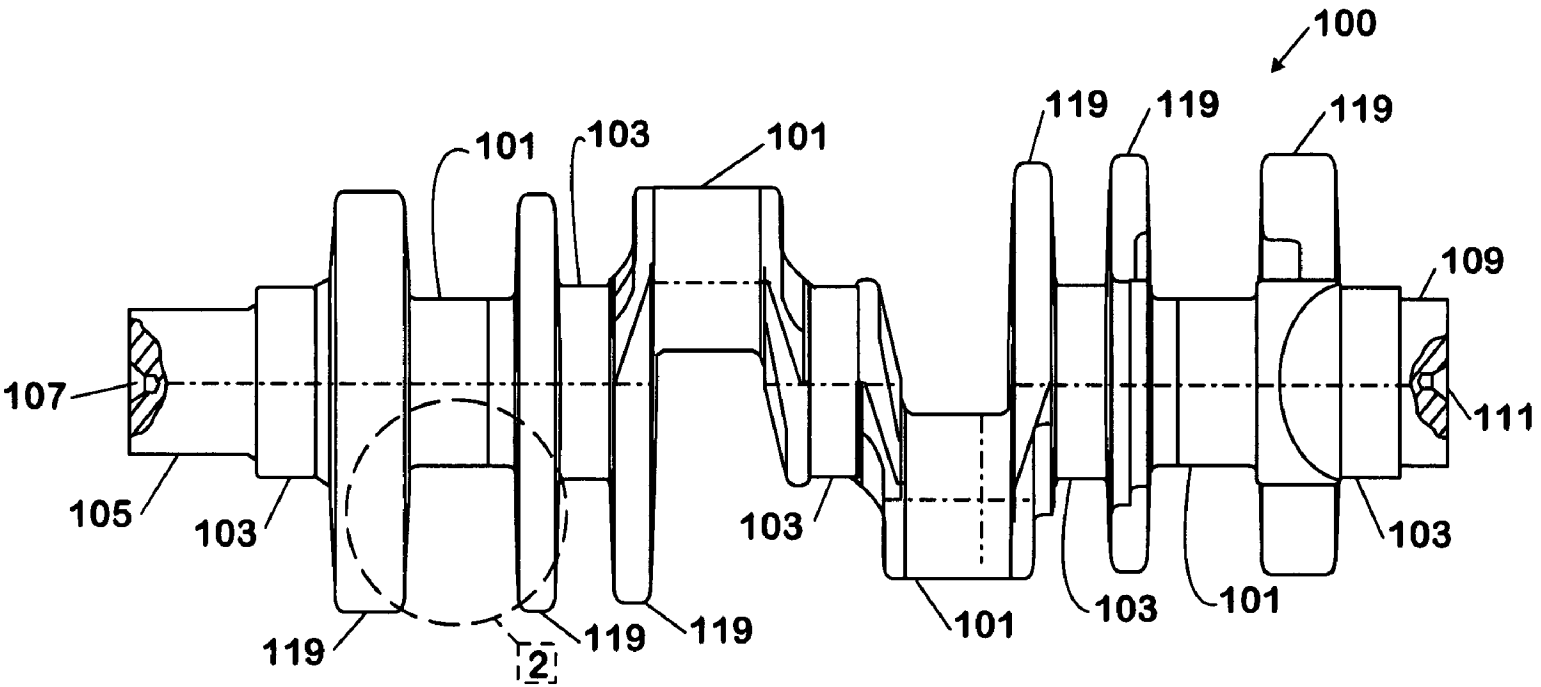
FIG. 1 is a radial view of a crankshaft which may be straightened in accordance with the invention.

A typical crankshaft is shown in FIG. 1. This crankshaft is configured for use in a V-8 internal combustion engine, preferably a diesel engine, but the advantages of this invention can be realized when used not only on a crankshaft resembling the one shown, but any eccentric shaft, such as a crankshaft or a camshaft, used on any engine or machine. A crankshaft 100 typically includes at one end, a cylindrical front seal surface 105 to engage a conventional front seal (not shown) disposed on a front side of an engine. On the other end, a rear seal surface 109 similarly provides engagement of a conventional rear crankshaft seal (not shown) disposed on a rear side of the engine. Intermediate its ends, the crankshaft 100 has five main journals 103 which engage in a conventional manner main bearings (not shown) in the crankcase (not shown) to support the crankshaft 100, and four crankthrows or crankpins 101 to which conventional connecting rods (not shown) are connected to input the power from the pistons to the crankshaft 100. Disposed between and separating the crankpins 101 from the main journals 103 are counterweights 119 which form the walls between the main journals 103 and the crankpins 101. The crankshaft 100 further has a front target 107 and a rear target 111 identifying the centers of the front journal 105 and the rear journal 109 respectively defining an imaginary centerline 113 through the crankshaft 100, and providing points of engagement with a deep rolling machine 300 (shown in FIG. 3A). In an optimal condition, the crankshaft centerline 113 is a straight line coinciding with the axis of rotation extending between the front target 107 and rear target 111.

Figure 2:
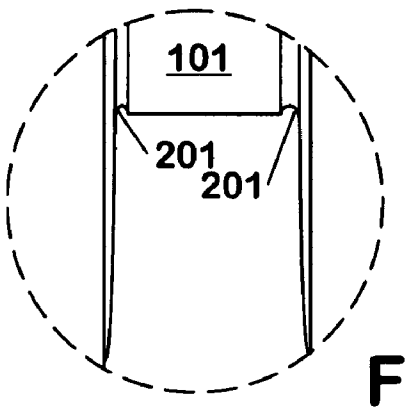
FIG. 2 is an enlarged detail of the area 2 of the crankshaft of FIG. 1 illustrating the fillets or grooves formed between the crank pin and the counterweight.
Figure 3A:
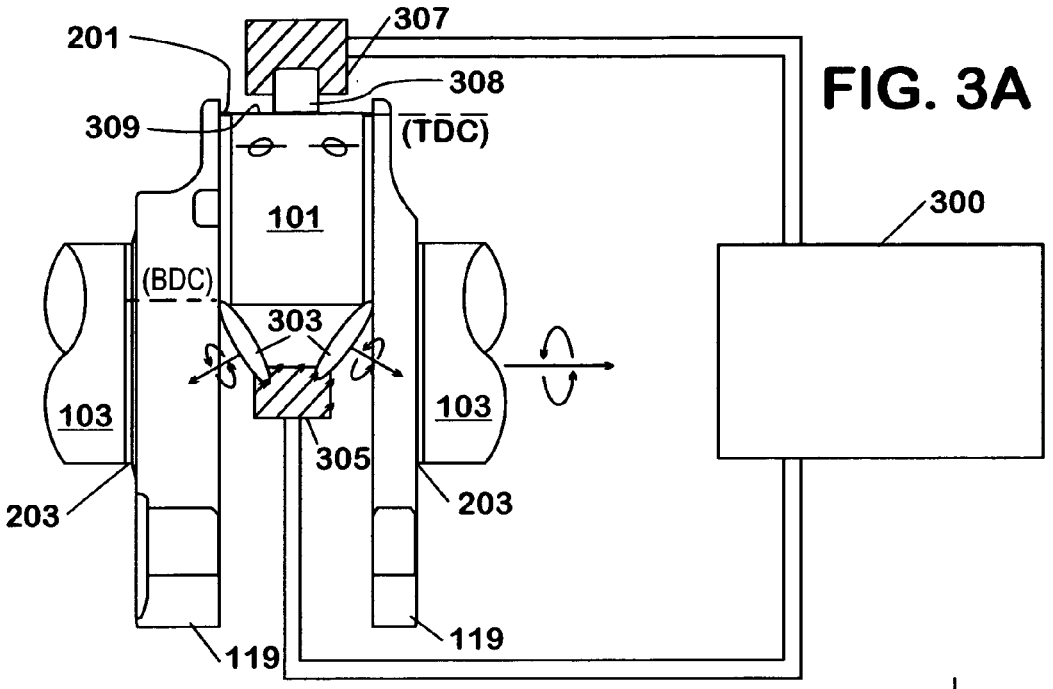
FIG. 3A is a schematic illustration of a portion of the crankshaft of FIG.1 engaged in rollers of a fillet rolling apparatus which may be used to practice the invention.

A detailed view of the intersection between two adjacent counterweights 119 around one crankpin 101 is shown in FIG. 2. A continuous peripheral groove or fillet 201 can be seen on either side of the crankpin 101, the groove 201 having a smooth radius blending into the counterweight 119. Similar grooves are found on either side of each crankpin 101. As shown in FIG. 3A, a similar continuous peripheral groove 203 is located between each main journal 103 and the adjacent counterweight 119. Each of the grooves 201, 203 is located in a stress concentration area on the crankshaft 100 during operation, and is intended to alleviate the stresses going through it during engine operation. These grooves are manufactured to provide residual compressive stresses as a result of the induction hardening operation in the surface in these areas, to help offset tensile stresses that occur during operation.

In some instances, crankshafts that undergo hardening develop problems with the straightness of their centerlines. This invention presents a method to straighten the centerline 113 of a crankshaft 100, without compromising the residual compressive stresses provided in each groove 201, 203, after the crankshaft 100 has undergone an induction hardening process. Traditional hardening operations for crankshafts, for example deep fillet rolling, cause the metal crystals in the material to elongate and work harden. In the case where induction hardening is used, the metal structure is martensitic and behaves differently when subjected to loading.

A deep rolling machine 300, which holds and rotates the crankshaft 100 about the axis between the targets 107 and 111, has appropriate crankpin structures 305 with rollers 303 running in each crankpin groove 201, and is able to follow each crankpin 101 in its orbit as the crankshaft 100 rotates about its centerline 113 without losing contact between the rollers 303 and the grooves 201 is used to straighten the induction hardened shaft, as shown in FIG. 3A. Similarly, an appropriate support structure 307 with rollers 308 is provided to run on the body of the crankpin 309 without losing contact between the rollers 308 and the body of the crankpin 309.

Except for the programming, the deep roller machine 300, as used for straightening crankshafts, is a typical machine known in the art for deep rolling of fillets in crankshafts for hardening the crankshaft by cold working the material, such as the software driven, electronically-controlled deep fillet rolling machine illustrated in U.S. Pat. No. 5,493,761, which is incorporated herein by reference. The deep roller machine 300 used for this invention is capable of imparting through the rollers 303 a compressive force 301 to the grooves 201 of the crankshaft. However, the application of the compressive force 301 to the grooves 201 is arranged to act only for a predetermined angle of rotation of the crankshaft 100 as it rotates in the deep rolling machine 300. The rollers 308 ride against the central portion of the crankpin between the rollers to resist and divide the radial (relative to the crankpin) component of the compressive force 301. This resistance and division of the compressive force 301 is made possible by forcible engagement of the grooves 201.

Figure 3B:
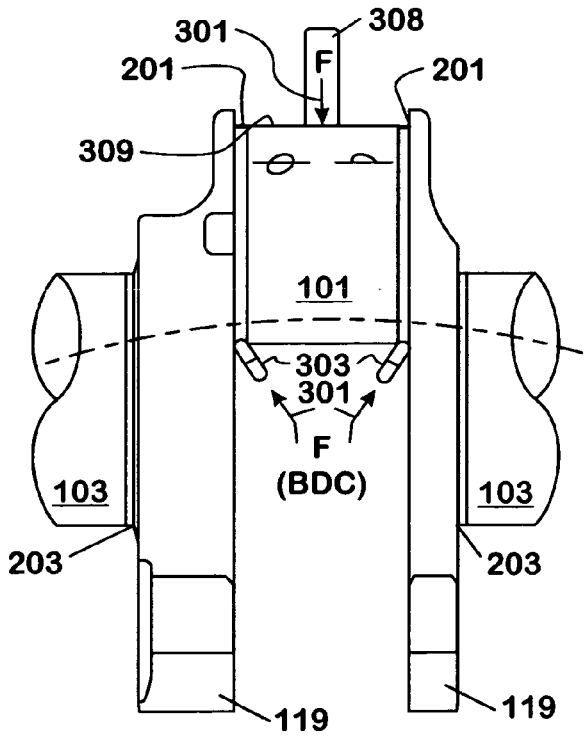
FIG. 3B is a schematic illustration of the crankshaft portion of FIG. 3A showing the selective application of rolling forces in accordance with the practice of the invention.
Figure 3C:
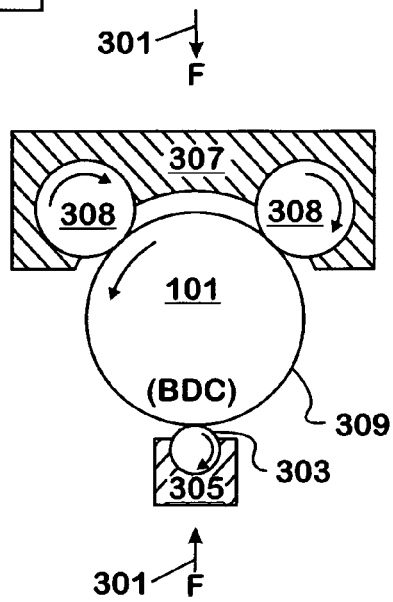
FIG. 3C is a schematic illustration of a cross section of the crankshaft portion of FIG. 3A showing the selective application of rolling forces in accordance with the practice of the invention.

The compressive force 301 is the force that causes the crankshaft 100 to deform in the section clamped by the machine 300, in this case, the crankpin 101. The rotational orientation of the crankshaft 100 in the machine 300 is advantageously controlled and known. The compressive force 301 acts during the time when the crankpin 101 is substantially at or approaching a position adjacent rotationally to a predetermined rotational position offset relative to a Top Dead Center (TDC) known mounting rotational position, and the rollers 303 are substantially at, or ramping up or down from, a position rotationally opposed to a corresponding Bottom Dead Center (BDC) location of the crankpin 101, as is shown in FIG. 3B and FIG. 3C. Through the application of each compressive force 301, the section of the crankshaft 100 that includes the crankpin 101 between the rollers 303 is straightened through the flow of solid material or plastic deformation inside each groove 201 by the action of the axial components of the compressive forces 301 applied through the rollers 303. The compressive forces 301 maintain the material of the crankshaft 100 in compression, and thus, do not lessen its strength.

Figure 4A:
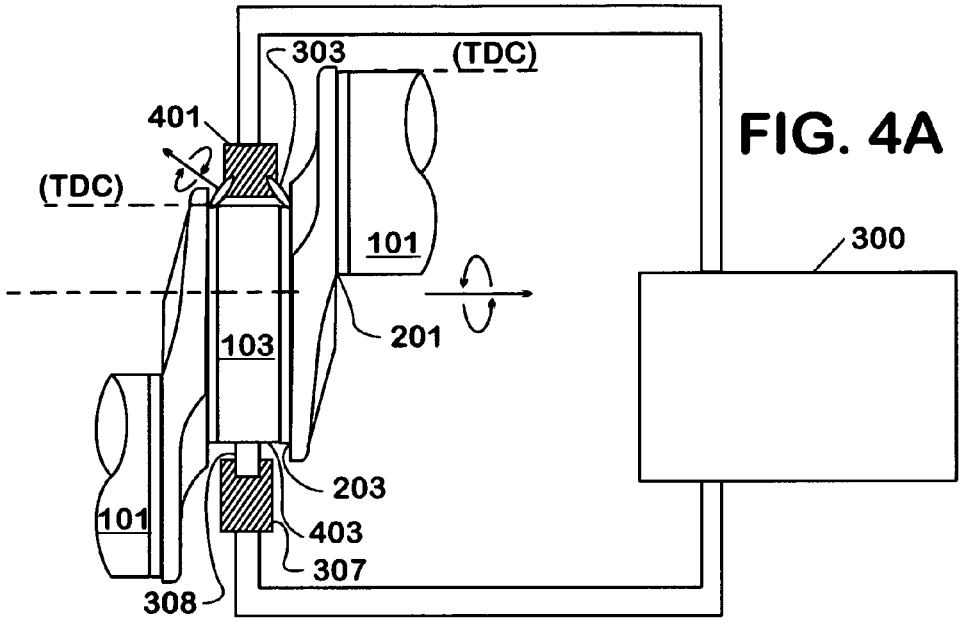
FIG. 4A is a schematic illustration of a portion of the crankshaft of FIG.1 engaged in rollers of a fillet rolling apparatus which may be used to practice the invention.

The deep roller machine 300 used for this invention is also capable of clamping a main journal 103, as shown in FIG. 4A. An appropriate journal structure 401 has rollers 303 in contact with the journal grooves 203 and a support structure 307 having rollers 308 is in contact with the journal body surface 403 of the journal 103. The application of the compressive force 301 is again arranged to act only for a predetermined angle of rotation of the crankshaft 100 as it rotates in the deep rolling machine 300.

Figure 4B:
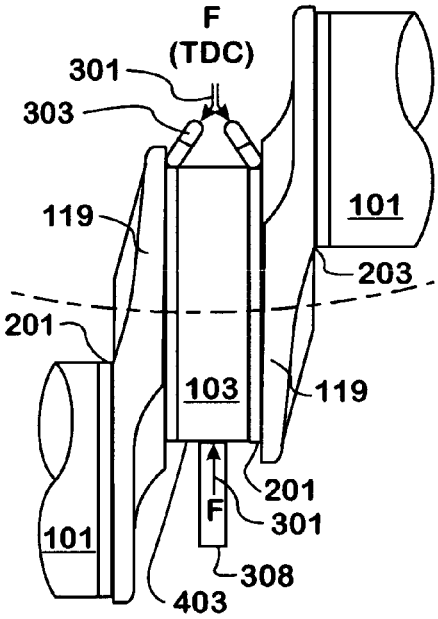
FIG. 4B is a schematic illustration of the crankshaft portion of FIG. 4A showing the selective application of rolling forces in accordance with the practice of the invention.
Figure 4C:
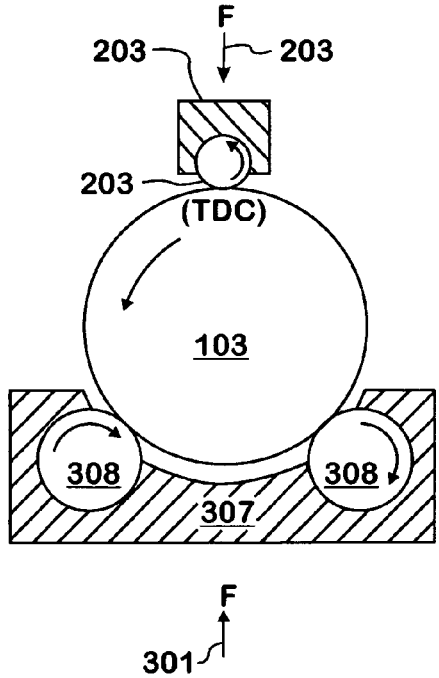
FIG. 4C is a schematic illustration of a cross section of the crankshaft of FIG. 4A showing the selective application of rolling forces in accordance with the practice of the invention.

The compressive force 301 is the force that causes the crankshaft 100 to straighten in the section clamped by the machine 300, in this case, the journal 103. The compressive force 301 acts through the rollers 303 on the grooves 201 during a predetermined circumferential segment substantially at, or ramping up or down from, a rotational position of the crankshaft 100 corresponding to a plane of maximum positive run-out while the rollers 308 are spaced along across a diametrically opposed circumferential segment to resist and divide the radial component of the compressive force 301 as is shown in FIG. 4B and FIG. 4C. The compressive forces 301 may advantageously be an impulse force applied to a central location of the predetermined circumferential segment. Through the application of each compressive force 301, the section of the crankshaft 100 that includes the journal 103 between the rollers 303 is straightened through the flow of solid material or plastic deformation inside each groove 201 by the action of the axial components of the compressive forces 301 applied the rollers 303. These compressive forces do not put the material of the crankshaft 100 into tension, and thus, do not lessen its strength.

In the straightening of the crankshaft 100 through either the crankpin 101 or the journal 103, because the compressive force 301 is not uniformly applied, but only at, or ramping up or down from, a particular rotational position, the flow of material or plastic deformation takes place, primarily in one circumferential segment of the crankpin 101 or journal 103 while little or no material flow or plastic deformation takes place on the diametrically opposed segment. This results in slightly changing the angle between the crankpin 101 or journal 103 and the adjacent structure, the counterweight 119 in this case, in the radial plane of crankshaft rotation in which the compressive force 301 is applied.

Figure 5:
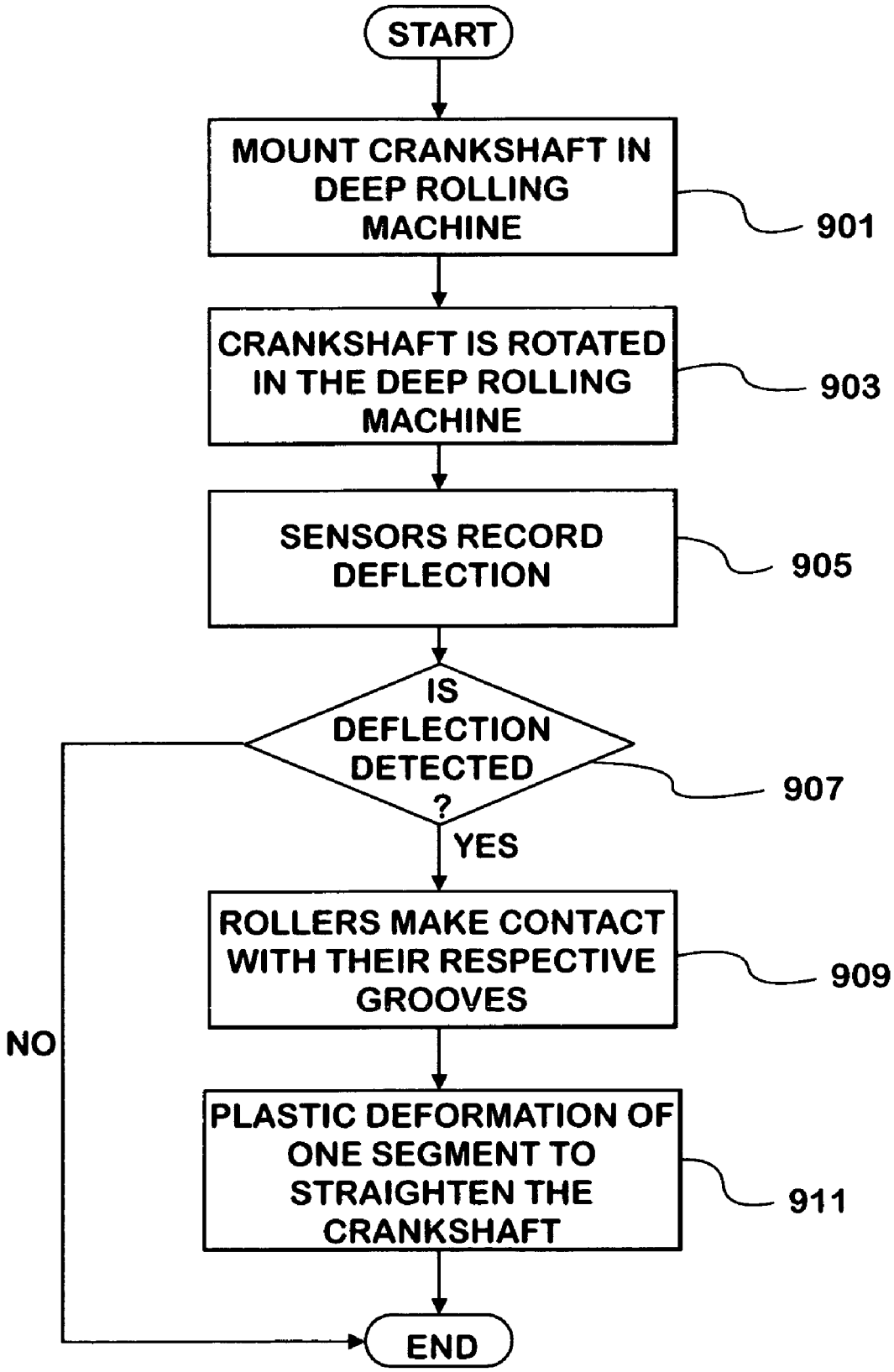
FIG. 5 is a flowchart representation of a method in accordance with the invention.

The straightening method of a crankpin 101, shown for example, for the crankshaft 100 is shown in FIG. 5 as a flowchart. The method shown in FIG. 5 applies for the straightening of a crankpin 101, but is also applicable to the straightening of the journal 103 as presented earlier, and also for the straightening of a feature on any eccentric shaft, like for example the straightening of a lobe or a journal feature on a camshaft.

The crankshaft 100 is mounted by targets 107 and 111 for rotation in the deep rolling machine 300 in step 901 of FIG. 5, the crankshaft 100 is rotated in the deep rolling machine 300 in step 903. Appropriate sensors sense the rotational position and alignment of the crankpin 101 during the rotation of the crankshaft 100 to record the angular position thereof relative to a known crankshaft reference position, such as a plane established between TDC and BDC of the pin 101, as well as deflection in step 905. If deflection is detected in the distance between the crankpin 100 and the axis of rotation of the crankshaft, as defined by a line connecting the front target 107 and the rear target 113, a decision is made in step 907 and adjustments are made to bring the centerline of rotation closer to the ideal centerline 113 of the crankshaft 100. Each roller 303 makes contact with its respective groove 201 on either side of a crankpin 101 and the rollers 308 engage the body portion 309 of the crankpin 101 in step 909. The deep rolling machine 300 may be capable of engaging a single crankpin 101 or a single main journal 103, or a plurality of them simultaneously. Additionally, the rollers 308 have fixed axes to provide passive resistance to the compressive forces 301 generated by the rollers 303 but alternatively may be actively loaded by the structures 307. Once the rollers 303 are engaged in their respective grooves 201 and the rollers 308 engaged on the body surface, a compressive force 301 is imparted through each roller 303 and/or 308 as described above. This compressive force 301 makes adjustments to the straightness of the crankshaft 100 in step 911.

Figure 6:
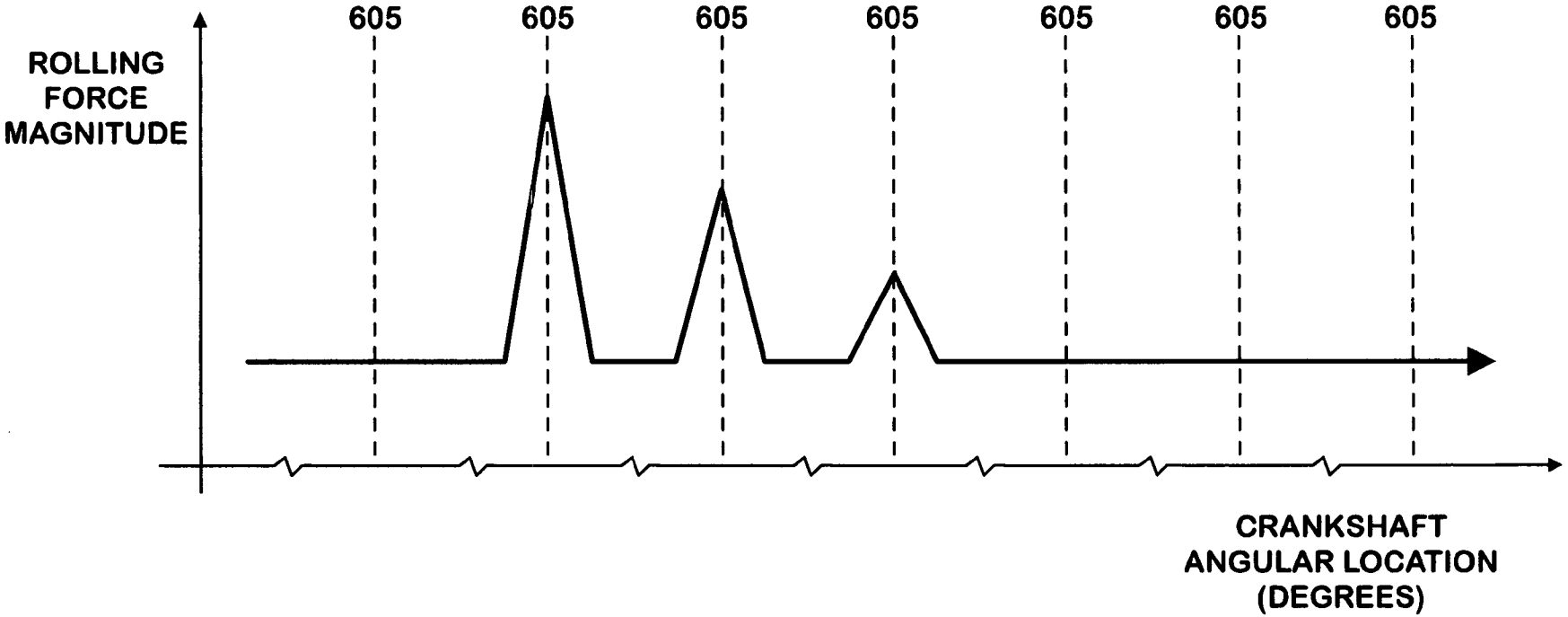
FIG. 6 is a graphical representation of the magnitude of the compressive forces for crankshaft angular rotations in accordance with the practice of the invention.

In the case of the crankpins 101 of crankshaft 100, it has been found that the plane of maximum run-out is coincident with TDC for each crankpin. In the case of the journals 103 and other eccentric shafts, the plane of maximum run-out may be in another diametrical plane. FIG. 6 illustrates the application of the compressive force 301 when the plane of maximum run-out corresponds to an angle 605 relative to an initial mounting rotational position of the crankshaft 100. Each application of the compressive force 301 occurs once for a full revolution of the crankshaft 100.

In FIG. 6, each rotation of the crankshaft 100 is shown with respect to a specific crankpin 100 engaged by the deep rolling machine 300. The duration of application of the compressive force 301 is shown as ramping up before the angle 605, reaching a maximum value at the angle 605, and ramping back down after the angle 605 to a low nominal value at least sufficient to maintain the engagement of the rollers 303, 308 that could be zero. After each application of the compressive force 301, a computer connected to sensors makes a determination on whether the crankshaft 100 is in a state of acceptable straightness. If the crankshaft 100 straightness is still not acceptable, an additional application of the compressive force 301 is required, which can have an equal, lesser or greater magnitude than the first application. This process is repeated until the crankshaft 100 has attained a desired straightness for the crankpin 101 that is engaged. The magnitude of the compressive force 301 depends on the amount of deflection that is being corrected, and may advantageously be between about 6 to 17 kN. The deep rolling machine 300 then disengages the crankpin 101 and proceeds to engage an adjacent crankpin 101 as described earlier. The straightening process may be repeated on the adjacent crankpin 101. Alternatively, all of the crankpins may be engaged and straightened sequentially as the crankshaft rotates. A similar process may be applied to the main journals. After each crankpin 101 and/or main journal has been subjected to the straightening process, the crankshaft 100 should be acceptably straight.

Figure 7A:
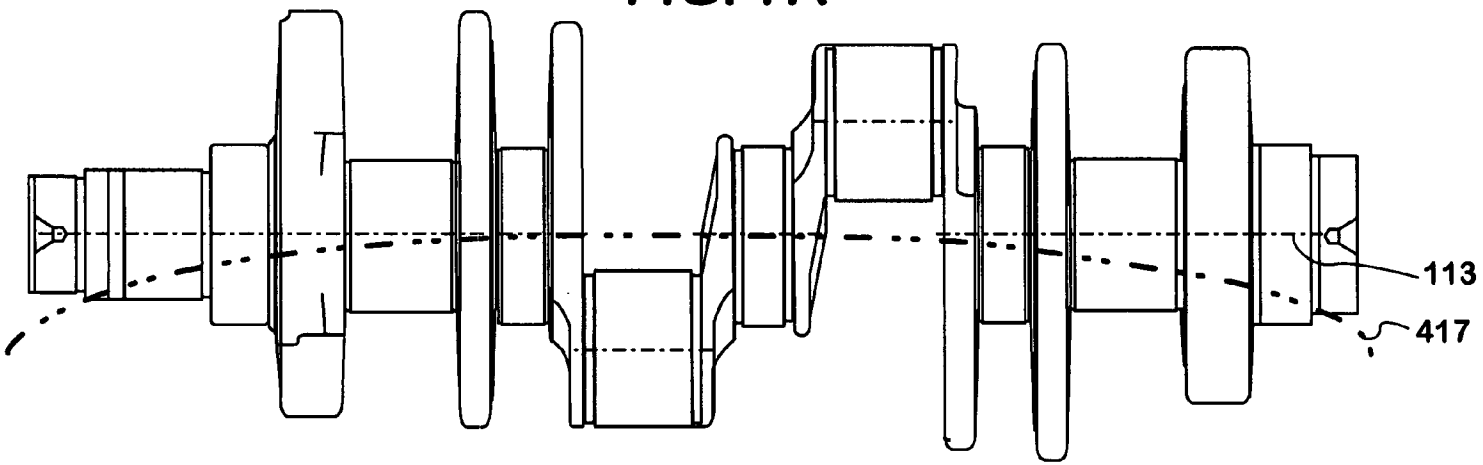
FIG. 7A is an illustration of a crankshaft having its centerline bowed out of alignment, prior to practicing the invention.
Figure 7B:
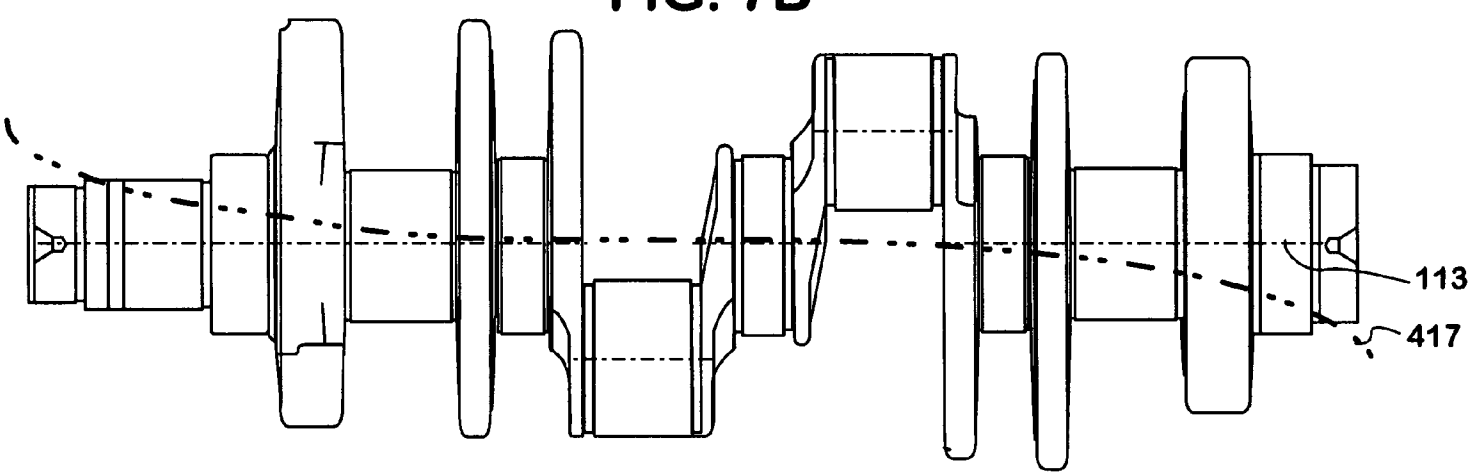
FIG. 7B is an illustration of a crankshaft having its centerline S-shaped out of alignment, prior to practicing the invention.

Non acceptable shapes of crankshafts can be found in many different forms. As is shown in FIG. 7A and FIG. 7B, a crankshaft can have a bowed centerline 417 or an S-shaped centerline 415. These are two examples of the at least 10 different families of distortions that have been observed in crankshafts thus far, whose centerlines may deviate three-dimensionally from a desired straight centerline 113. This invention is advantageously suitable to manage any deflection of the centerline 113 of a crankshaft 100, because it is able to align each crankpin 101 or main journal 103 independently of the rest. The ability to straighten an eccentric shaft having a martensitic crystalline structure without compromising its strength, and the ability to perform a straightening operation quickly and using common equipment in the art of manufacturing crankshafts are additional advantages. This embodiment involves operations made to crankshafts designed for use in internal combustion engines. This method, however, would work equally well for crankshafts, camshafts or any eccentric shaft designed for any other application or machine.

Figure 8:
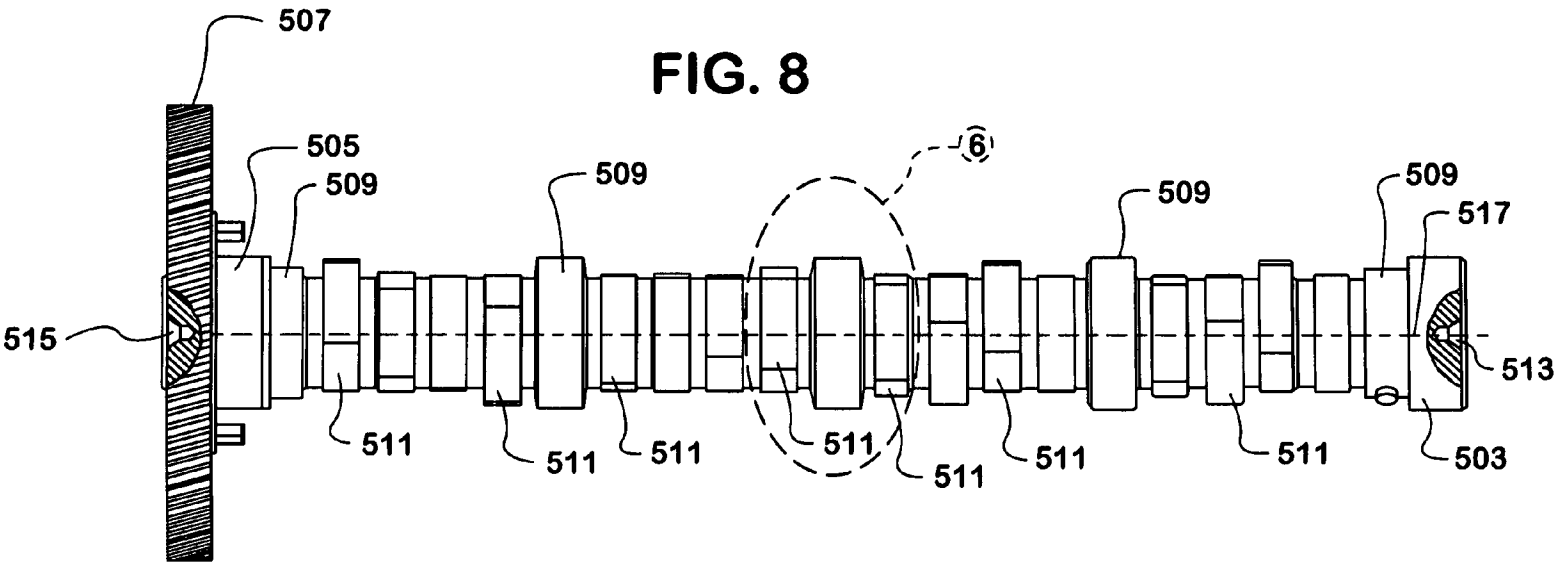
FIG. 8 is a radial view of a camshaft which may be straightened in accordance with the invention.
Figure 9:
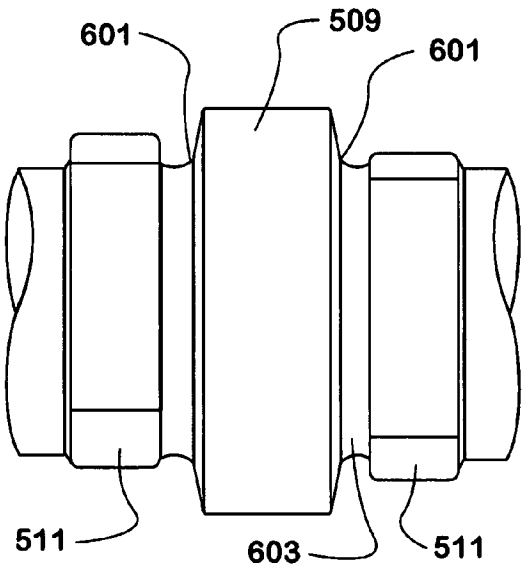
FIG. 9 is an enlargement of the area 6 of the camshaft of FIG. 8 illustrating the fillets formed between the journal and the main shaft.

The Embodiment of FIGS. 8–10

In this embodiment, the method of the invention is applied to straightening a camshaft. A typical camshaft 501 is shown in FIG. 8. This camshaft 501 is configured for use in a V-8 internal combustion engine, preferably a diesel engine, but the advantages of this invention can be realized when used not only on a camshaft resembling the one shown, but any camshaft used on any engine or machine. A camshaft 501 typically may include at one end, a cylindrical front seal surface 503 to engage a conventional front seal (not shown) disposed on a front side of an engine. On the other end, a rear seal surface 505 similarly provides engagement of a conventional rear crankshaft seal (not shown) and a rear driving gear 507 disposed on a rear side of the engine. Intermediate its ends, the camshaft 501 may have one or more main journals 509 which engage in a conventional manner bearings (not shown) in the engine (not shown) to support the camshaft 501, and a plurality of lobes 511 that are engaged by conventional cam followers (not shown) or valve lifters (not shown) to actuate intake and exhaust valves for the cylinders. On a camshaft 501 for a V8 engine, as shown, sixteen lobes 511 are separated by the journals 509 in sets of four. The camshaft 501 further has a front target 513 and a rear target 515 identifying the centers of the front journal 503 and the rear journal 505 respectively, defining an imaginary centerline 517 through the camshaft 501, and providing points of engagement with a deep rolling machine. In an optimal condition, the camshaft centerline 517 is a straight line coinciding with the axis of rotation extending between the front target 513 and rear target 515.

A detailed view of the intersection between two adjacent sets of lobes 511 around one journal 509 is shown in FIG. 9. A continuous peripheral groove or fillet 601 can be seen on either side of the journal 509 forming a smooth radius blending into the main shaft 603. Similar fillets are found on either side of each journal 509. The area of each of the fillets 601 is a stress concentration area on the camshaft 501 during operation. Each fillet 601 is intended to alleviate the stresses going through it during engine operation. These fillets are manufactured to provide residual compressive stresses in the steel in these areas. The compressive stresses in the fillets help offset tensile stresses that occur during operation.

Figure 10A:
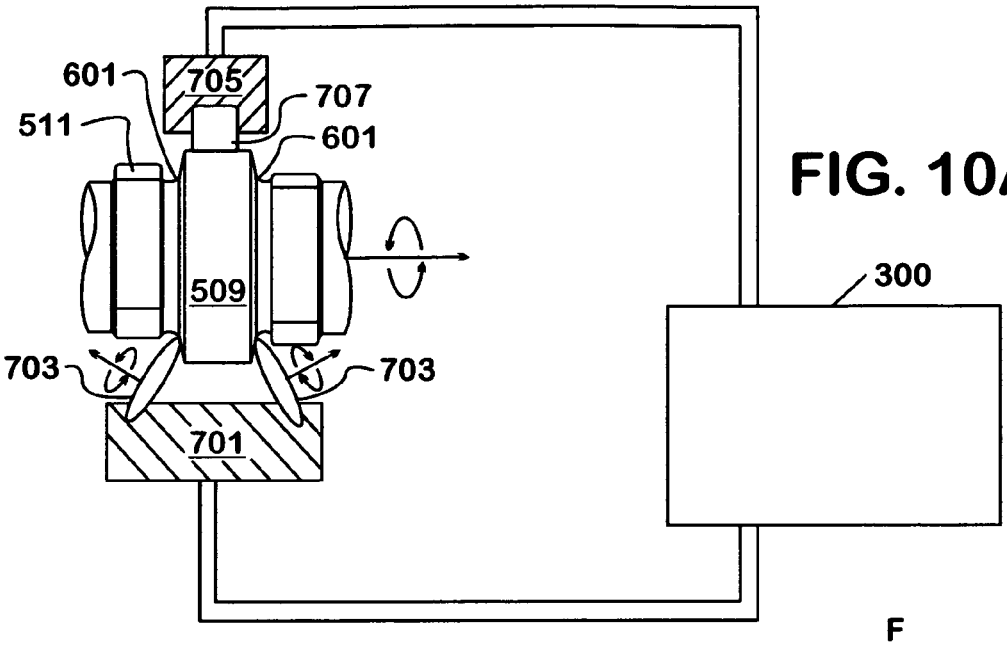
FIG. 10A is a schematic illustration of a portion of the camshaft of FIG. 8 engaged in rollers of a fillet rolling apparatus which may be used to practice the invention.

In some instances, camshafts that undergo a hardening process may develop problems with the straightness of their centerlines. This invention presents a method to straighten the centerline 517 of a camshaft 501, without compromising the residual compressive stresses provided in each fillet 601, after the camshaft 501 has undergone a hardening process. As shown in FIG. 10A, a deep rolling machine 300 may be used to hold and rotate the camshaft 501 about the rotational axis 517 between the targets 513 and 515. An appropriate journal structure 701 with rollers 703 running on each fillet 601, may be provided to follow each journal 509 without losing contact between the rollers 703 and the fillets 601. Similarly, an appropriate support structure 705 with rollers 707 may be provided to run on the body of the journal 509 without losing contact between the rollers 707 and the body of the journal 509.

Figure 10B:
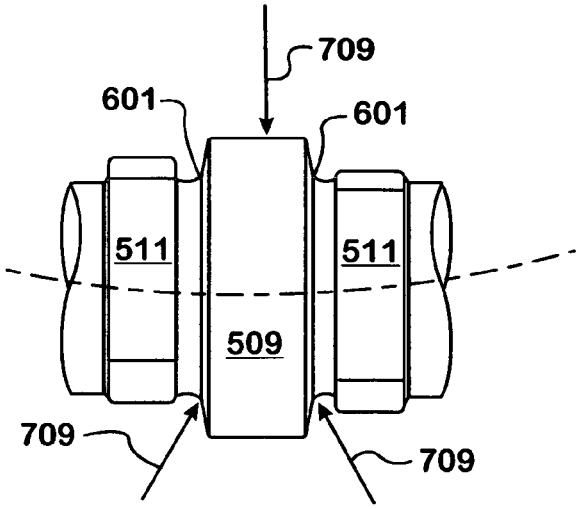
FIG. 10B is a schematic illustration of the camshaft portion of FIG. 10A showing the selective application of rolling forces in accordance with the practice of the invention.
Figure 10C:
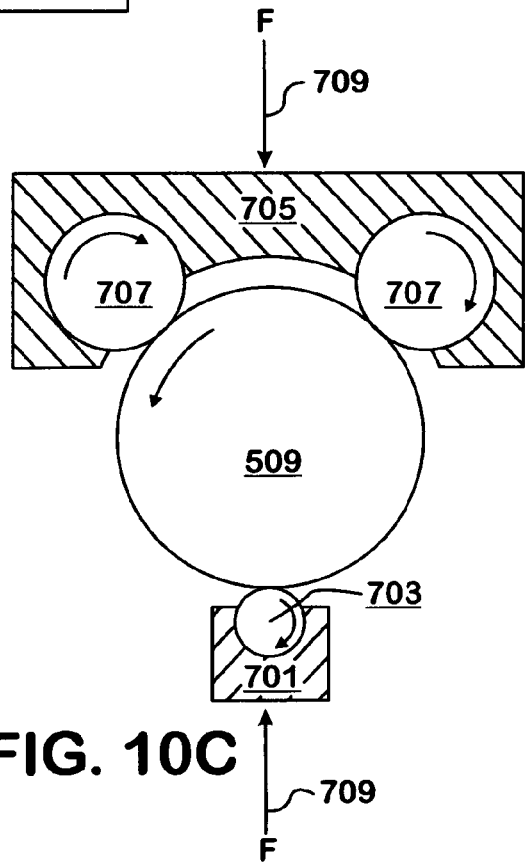
FIG. 10C is a schematic illustration of a cross section of the camshaft portion of FIG. 10A showing the selective application of rolling forces in accordance with the practice of the invention.

A compressive force 709 would cause the camshaft 501 to straighten in the section clamped by the machine 300, in this case, the journal 509 shown in FIG. 10B by acting through the rollers 709 on the grooves 601 during a predetermined circumferential segment substantially at, or ramping up or down from, a rotational position of the camshaft 501 corresponding to a plane of maximum run-out while the rollers 707 are arranged to resist and divide the radial component of the compressive force 709 as shown in FIG. 10C. Through the application of each compressive force 709, the section of the camshaft 501 that includes the journal 509 between the rollers 703, 707 may be straightened by causing plastic deformation or flow of solid material around each fillet 601 by the action of the axial components of each compressive force 709. These compressive forces do not put the material of the camshaft 501 into tension, and thus, do not lessen its strength.

In the straightening of the camshaft 501 through the journal 509, because the compressive force will not be uniformly applied, but only at, or ramping up or down from, a particular rotational position, the flow of material or plastic deformation may take place primarily in one circumferential segment of the journal 509 while little or no material flow or plastic deformation may take place on the diametrically opposed segment. This may result in slightly changing the angle between the journal 509 and the adjacent shaft structure in the radial plane of camshaft rotation in which the compressive force 709 is applied, i.e., in the plane of maximum run-out.

Each compressive force 301, 709 is equal in magnitude in a radial force balance direction. The application of each compressive force 301, 709 may occur in any desired scheme that is a function of angle of rotation of the crankshaft 100 or the camshaft 501 mounted in the deep rolling machine 300, or a function of timing with respect to the rotational speed of the crankshaft 100 or the camshaft 501 mounted in the deep rolling machine 300. Angular sensors, visual sensors, rotational position sensors, stress sensors, positional sensors, timing sensors, and so forth, can sense the angular position or the rotational speed of the crankshaft 100 or the camshaft 501 as mounted in the machine 300 during operation.

The present invention may be embodied in other specific forms than described above without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method of straightening an induction hardened eccentric shaft having a rotational axis comprising the steps of:

engaging with a set of rollers an integrally-formed element of the induction hardened eccentric shaft, said element having a centerline;

engaging a mid-section of the element with at least one support roller;

rotating the shaft; and selectively applying through the set of rollers to the element of the eccentric shaft a compressive force sufficiently large to align the centerline of said element with the rotational axis of the eccentric shaft, said sufficiently large compressive force being applied only during contact of said set of rollers with a predetermined circumferential segment of the element, said segment being smaller than 180°.

2. The method of claim 1, wherein the compressive force is variable within said predetermined circumferential segment of the element.

3. The method of claim 1, wherein a compressive force insufficient to align the centerline of said element with the rotational axis of the eccentric shaft is applied to the portion of said shaft not within said predetermined circumferential segment of the element.

4. The method claim of 1, wherein the eccentric shaft is a crankshaft.

5. The method of claim 4, wherein the element is at least one of a crankpin and a journal.

6. The method of claim 1, wherein a material in an area of contact between said roller and said predetermined circumferential segment of said element is martensitic steel.

7. The method of claim 1, wherein the eccentric shaft is a camshaft.

8. The method of claim 1, wherein the compressive force in the application step is applied at an angle to a fillet disposed between said element and adjacent shaft structure.

9. The method of claim 1, wherein the compressive force is applied sequentially to a plurality of elements of the eccentric shaft.

10. A method for straightening an induction hardened eccentric shaft comprising the steps of:

mounting the induction hardened eccentric shaft into a deep fillet rolling machine;

rotating the induction hardened eccentric shaft;

determining the straightness of the induction hardened eccentric shaft;

selectively applying through a set of rollers and a support roller to an element of the induction hardened eccentric shaft a compressive force sufficiently large to reposition said element relative to a rotational axis of the induction hardened eccentric shaft, said sufficiently large compressive force being applied only during contact of said set of rollers with a predetermined circumferential segment of the element;

repeating the application of a compressive force on the element of the induction hardened eccentric shaft at least one of: once and more than once until a portion of the induction hardened eccentric shaft adjacent to the element is substantially straight.

11. The method of claim 10, wherein the compressive force is an impulse force applied at a central location of the predetermined circumferential segment of the element between each of the set of rollers and the support roller.

12. The method of claim 10, wherein the compressive force is variable within said predetermined circumferential segment of the element.

13. The method of claim 10, wherein a compressive force insufficient to reposition said element relative to the rotational axis of the eccentric shaft is applied to the portion of said shaft not within said predetermined circumferential segment of the element.

14. The method of claim 10, wherein the measuring step repeats, following at least one selective application of the compressive force.

15. A method for straightening a hardened eccentric shaft comprising the steps of:

engaging with a first roller a first continuous peripheral groove disposed about said shaft at a first intersection of an element of said shaft with adjacent shaft structure;

engaging with a second roller a second continuous peripheral groove disposed about said shaft at a second intersection of said element of said shaft with adjacent shaft structure, said second intersection being axially displaced from said first intersection;

engaging with a third roller a body of the shaft, wherein the body of the shaft is disposed between the first intersection and the second intersection of said element;

rotating said shaft through a series of angular positions thereof;

applying a compressive force of variable magnitude through said rollers to both of said grooves and to said body;

varying the magnitude of the compressive force depending on the angular position of the eccentric shaft; and causing solid material flow adjacent to the element, thereby relocating the element relative to the adjacent shaft structure.

16. The method of claim 15 wherein magnitude of the compressive force varies from zero to an amount sufficient to cause plastic deformation in the grooves.

17. The apparatus of claim 15 wherein the compressive force is only applied over a circumferential segment of the element, said segment including a rotational plane of maximum run-out of said eccentric shaft.

18. The apparatus of claim 17, wherein the compressive force causes solid material flow in said circumferential segment, and no material flow in a diametrically opposed segment of said element.

19. The apparatus of claim 18, wherein the solid material is martensitic steel.

20. The apparatus of claim 15, wherein the compressive force is an impulse force applied at the intersection of the circumferential segment of the element and the rotational plane of maximum run-out.

* * * * *